United States Patent [19]

Nishimoto

[11] 4,253,655

[45] Mar. 3, 1981

[54] MULTIPLE BANK NOTE TEMPORARY STORING DEVICE FOR BANK NOTE TOTALING MACHINE

[75] Inventor: Seiya Nishimoto, Tokyo, Japan

[73] Assignee: Laurel Bank Machine Co., Ltd., Tokyo, Japan

[21] Appl. No.: 47,705

[22] Filed: Jun. 12, 1979

[30] Foreign Application Priority Data

Jun. 14, 1978 [JP] Japan ..... 53-72662

[51] Int. Cl.[3] ..... B65H 5/24; B65H 5/36

[52] U.S. Cl. ..... 271/216; 271/178; 271/151

[58] Field of Search ..... 271/216, 151, 213, 303, 271/182, 202, 3, 4, 178; 198/423

[56] References Cited

U.S. PATENT DOCUMENTS

| | | | |
|---|---|---|---|
| 1,434,014 | 10/1922 | Bombard et al. | 271/216 |
| 3,141,667 | 7/1964 | Novick | 271/216 |
| 4,020,972 | 5/1977 | Lundblad | 271/35 |
| 4,159,782 | 7/1979 | Swartzendruber | 271/263 |

FOREIGN PATENT DOCUMENTS

| | | | |
|---|---|---|---|
| 918709 | 2/1963 | United Kingdom | 271/86 |

*Primary Examiner*—Robert B. Reeves
*Assistant Examiner*—Brian Bond
*Attorney, Agent, or Firm*—Fleit & Jacobson

[57] ABSTRACT

Herein disclosed is a multiple bank note temporary storing device for use with a bank note totaling machine. The storing device includes a piling station for piling a multiplicity of discontinuously fed bank notes consecutively with a slight shift into a stepwise shape. Further inclusive is a temporary storing station formed in a clearance between conveyor belts for arranging the piled bank notes while allowing them to fall down into the clearance generally in parallel with the facing sides of the belts. Thus, the arranged bank notes can be fed as a whole selectively into their tray and the return exit of the bank note totaling machine. As a result, this totaling machine can be reduced in size but can accomplish its arranging and totaling operations in a reduced number of steps orderly and efficiently without any totaling error.

4 Claims, 10 Drawing Figures

MULTIPLE BANK NOTE TEMPORARY STORING DEVICE FOR BANK NOTE TOTALING MACHINE

BACKGROUND OF THE INVENTION

1. Field of the Invention

The present invention relates to a multiple bank note temporary storing device for use in a bank note totaling machine.

2. Description of the Prior Art

Recently, an automatic bank note totaling machine has been developed to eliminate the waste in the totaling labor for calculating work of the fares of buses or tax is while enhancing the totaling efficiency.

SUMMARY OF THE INVENTION

It is an object of the present invention to provide a multiple bank note temporary storing device which is incorporated in compact construction into a bank note totaling machine so that the totaling machine can be reduced in size but can accomplish its totaling operation orderly and efficiently without any error.

According to a major feature of the present invention, there is provided a multiple bank note temporary storing device for use with a bank note totaling machine, which device comprises: a piling station for piling a multiplicity of bank notes, which are fed discontinuously one by one, consecutively with a slight shift into a stepwise shape; and a temporary storing station formed in a clearance between conveyor belts for arranging the piled multiple bank notes while allowing them to fall down into said clearance generally in parallel with the facing sides of said conveyor belts so that the arranged bank notes can be fed as a whole selectively into the bank note tray and the return exit of said bank note totaling machine.

BRIEF DESCRIPTION OF THE DRAWINGS

Other objects and advantages of the present invention will become apparent from the following description taken in conjunction with the acompanying drawings, in which.

DESCRIPTION OF THE PREFERRED EMBODIMENT

Figure 1:
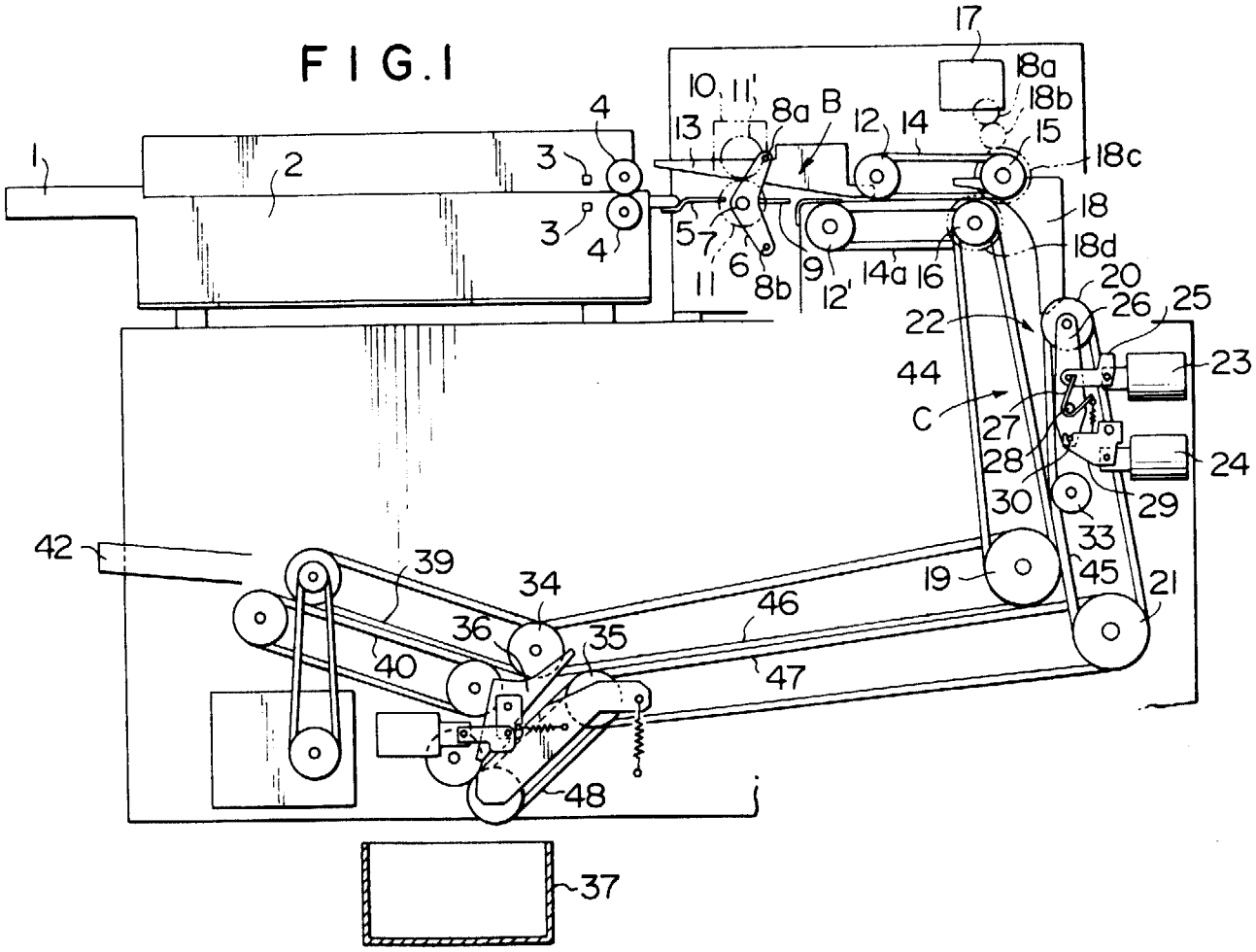
FIG. 1 is a diagrammatical side elevation showing the overall construction of a bank note totaling machine, in which a device for temporarily storing multiple bank notes according to the present invention is used.

The present invention will now be described in connection with the embodiment thereof with reference to the accompanying drawings. FIG. 1 is a diagrammatical side elevation showing the overall construction of a bank note totaling machine, in which a device for temporarily storing multiple bank notes according to the present invention is used. Indicated at reference numeral 1 is a bank note inlet, through which bank notes A are inserted discontinuously one by one. The bank notes A inserted are inspected as to their genuineness by an inspecting station 2. When a pair of facing photocells 3 generate signals in response to the passage of the bank notes A therethrough, a pair of taking rollers 4 feed out the bank notes A a preset distance.

There is arranged a piling station B downstream of the taking rollers 4. This piling station B is constructed of: a pair of rotary bails 6 having their centers of rotation fixedly fitted on the both ends of a shaft 7 which is mounted rotatably in the both side frames 43 of the bank note totaling machine downstream of a guide plate 5; two pairs of scraping rods 8*a* and 8*b* mounted to the both ends of the rotary bails 6 in an end-to-end facing relationship; a pair of conveyance guide plates 9 fixed to the shaft 7 between the two rotary bails 6; two pairs of upper and lower delivery rollers 12 and 12' arranged downstream of the conveyance guide plates 9 and shifted from each other; and a holding plate 13 extending at an inclination a smaller length between the taking rollers 4 and the upper delivery rollers 12 than that of the bank notes A so as to prevent the bank notes A from having their trailing end portion bulged to an excessive extent. Drive power is transmitted from a motor 10 to the power transmitting gear 11 of the shaft 7 through a power transmitting gear 11'. A pair of first belts 14 are made to run on the upper delivery rollers 12 and two upper downstream pulleys 15, whereas a pair of second belts 14*a* are made to run on the lower delivery rollers 12' and two lower downstream pulleys 16. Those pulleys 15 and 16 are constructed to have their coaxial power transmitting gears 18*c* and 18*d* driven by a motor 17 through power transmitting gears 18*a* and 18*b*.

There is arranged a temporary storing station C downstream or below those two pulleys 15 and 16. This temporary storing station C is constructed of: a third belt 44 made to run on both the not-shown pulley, which is coaxial with the pulleys 16, and a downstream or lower pulley 19; a fourth belt 45 corresponding to the third belt 44 and made to run on upper and lower pulleys 20 and 21; an intermediate roller 33 adapted to be driven by the fourth belt 45; and a guide fork 18 depending from the side of the pulley 15 to the pulley 20 such that a wedge-shaped clearance 22 is formed between the plane leading from the inner wall of the guide fork 18 to the upper outer side of the fourth belt 45 and the outer side of the third belt 44.

The temporary storing station C is further constructed of: a support plate 26 supported pivotally on a pin 28 and having its leading end rotatably supporting the pulley 20; a link 25 connecting the support plate 26 and a lock solenoid 23; a torsion spring 27 mounted on the pivot pin 28 for biasing the link 25 and accordingly the support plate 26 in one direction; a lock plate 29 having its portion pivotal; a lock releasing solenoid 24 connected to the lock plate 29; and an actuating pin 30 mounted to the other end of the support plate 26 and sized and positioned to engage with a notch which is formed in one end of the lock plate 29.

A pair of fifth belts 46 and 47 are made to run in parallel from the pulleys, which are made coaxial with the pulleys 19, and 21, to other pulleys 34 and 35, respectively. A change-over guide plate 36 is arranged in an interchangeable manner at the downstream ends of the two belts 46 and 47. There are arranged at one side of the change-over guide plate 36 a pair of discharge belts 39 and 40 which are extended downstream in parallel up to a return exit 42. At the other side of the guide plate 36, a conveyor belt 48 is extended downward at an inclination up to a bank note tray 37.

Figure 2:
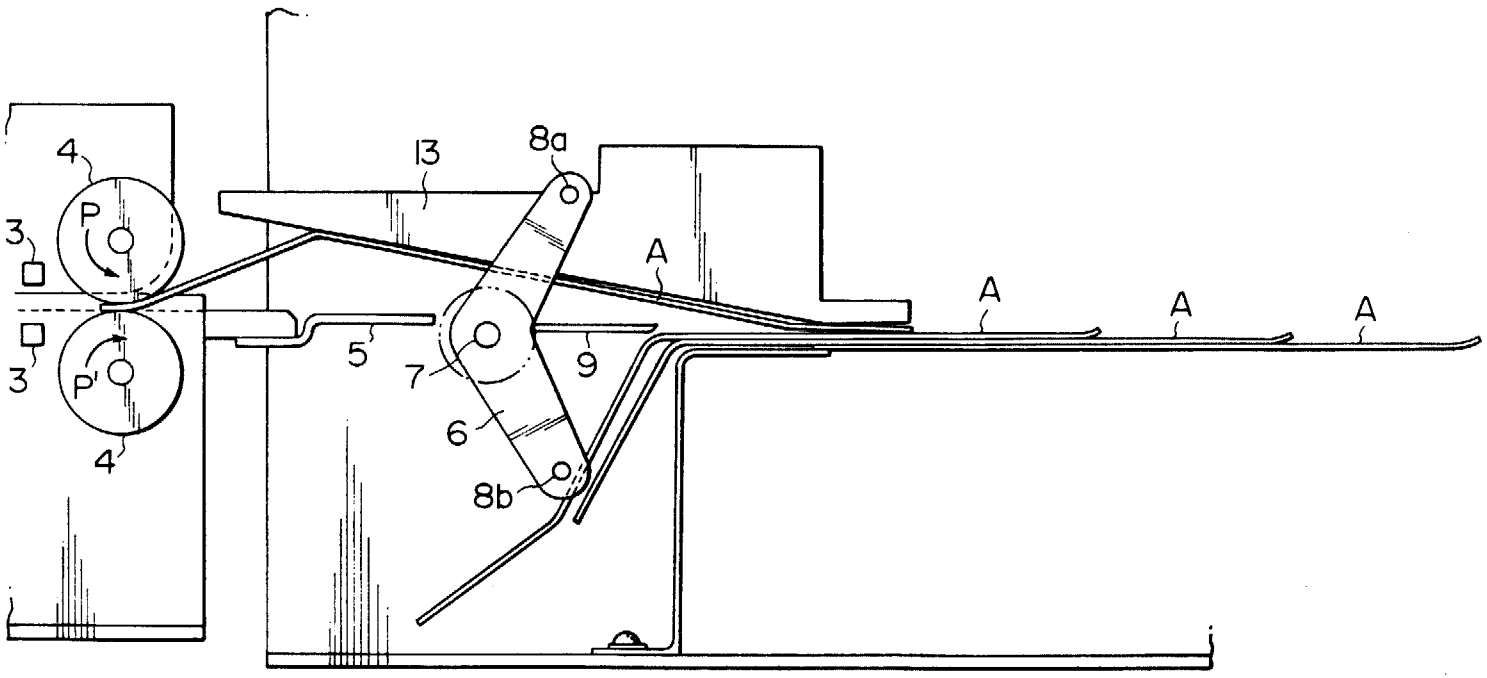
FIG. 2 is an enlarged illustrative view showing a portion of the bank note totaling machine of FIG. 1.
Figure 3:
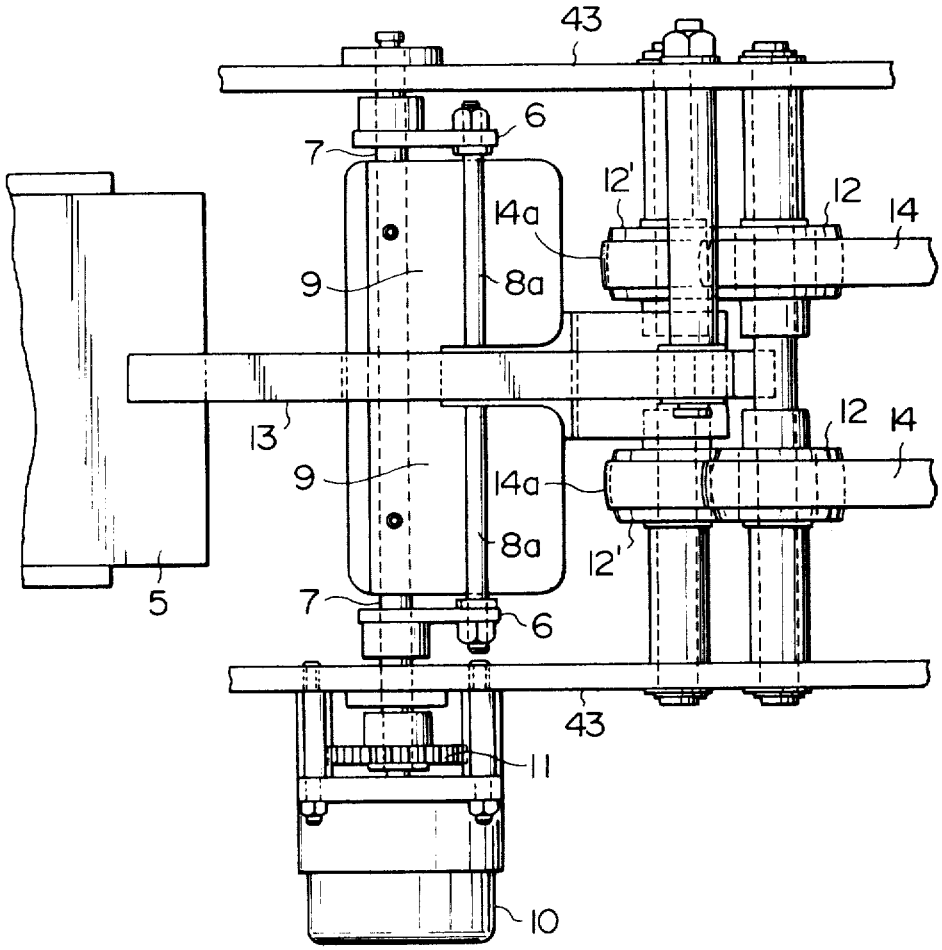
FIG. 3 is an enlarged top plan view showing a portion of the bank note totaling machine of FIG. 1.
Figure 4A:
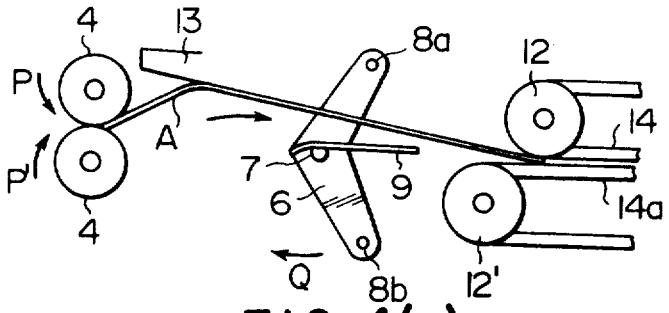
FIGS. 4(*a*) to 4(*g*) are illustrative views showing a portion of the bank note totaling machine of FIG. 1 so as to illustrate a series of operations.
Figure 4B:
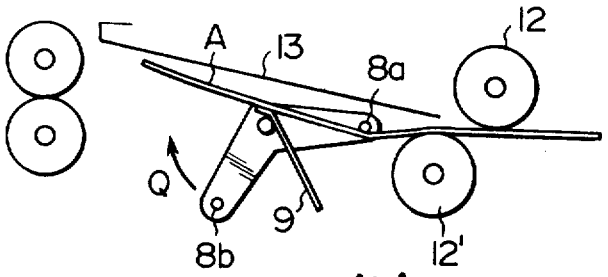
Figure 4C:
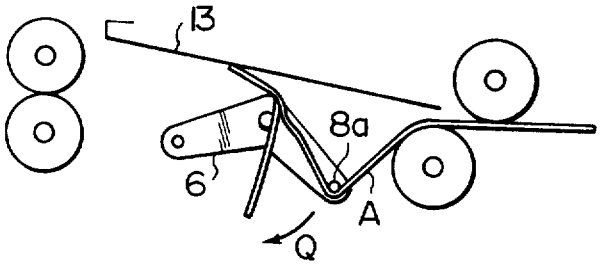
Figure 4D:
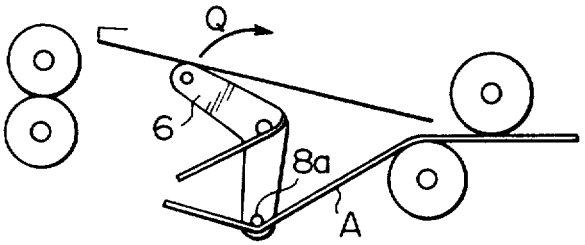
Figure 4E:
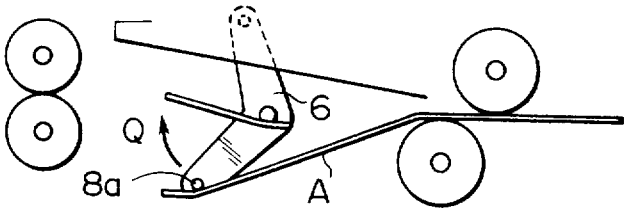
Figure 4F:
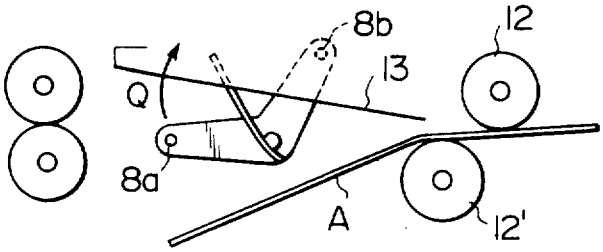
Figure 4G:
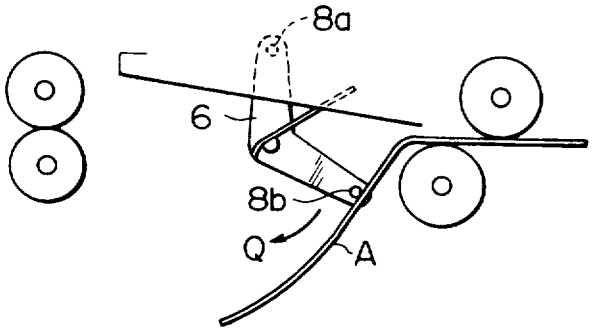

In operation, when the bank notes A are inserted into their inlet 1 discontinuously one by one, they are inspected as to their genuinness at the inspecting station 2 and then are conveyed through the passage between the photocells 3. In response to the signals generated by these photocells 3, the taking rollers 4 are turned in the directions shown at arrows P and P' in FIG. 2 so that the bank notes A are advanced downstream a preset distance. Then, the first bank note A is guided from the upper side of the guide plate 5 to the upper side of the conveyance guide plate 9 until its leading end is bitten by the upper delivery rollers 12. At this particular time, when the bank note A is being let off from the taking rollers 4, it can be prevented from being excessively bulged by the action of the holding plate 13, as best shown in FIG. 4(*a*).

Under this condition, the motor 10 is energized to start the rotations of the rotary bails 6 clockwise in the direction of arrow Q about the shaft 7 so that the bank note A is pushed down by means of the scraping rods 8*a* from the condition shown in FIG. 4(*a*) to the condition shown in FIG. 4(*b*) Then, the trailing end portion of the bank note A is further pushed down consecutively in the order shown in FIGS. 4(*c*), 4(*d*) and (*e*). After that, the rotary bails 6 are turned in the order shown in FIGS. 4(*f*) and 4(*g*) so that the trailing end portion of the bank note A is further pushed down by the actions of the other scraping rods 8*b*. In this instance, the not-shown shutter at the side of the bank note inlet 1 is kept closed until the rotary bails 6 are turned once to restore their condition shown in FIG. 4(*a*). When this condition is reached, the shutter is opened so that the next bank note A can be inserted.

By the time when the subsequent bank note A is fed likewise, the previous bank note A has already been brought into such a condition that it runs slightly ahead while having its leading end held between the first and second belts 14 and 14*a*. As a result, the subsequent bank note A is piled on the previous bank note A such that the leading end of the former is slightly shifted from that of the latter while forming a stepwise shape. Since, in this instance, the trailing end portion of the previous bank note A is pushed down, the subsequent bank note A is brought into a piled condition smoothly without any difficulty so that it can also have its trailing end portion pushed down in the order shown in FIGS. 4(*a*) to 4(*g*). As better seen from FIG. 2, therefore, a multiplicity of the bank notes A thus inserted discontinuously can be piled on another in a stepwise shape.

When, under that condition, the multiple bank notes A are advanced while being held between the first and second belts 14 and 14*a*, they are turned downward by the guide of the guide fork 18 until they fall down into the wedge-shaped clearance 22. In this way, when the bank notes A having been conveyed stepwise fall down into the clearance 22 of the temporary storing station C, they are arranged by their own weights. At this instant, when the lock releasing solenoid 24 is energized to disengage the notch of the lock plate 29 being pulled from the actuating pin 30 of the support plate 26, the fourth belt 45 is pushed to the third belt 44 together with the pulley 20 by the biasing force of the torsion spring 27. On the other hand, when the lock solenoid 23 is energized, the lock plate 29 is brought into engagement with the actuating pin 30 so that the fourth belt 45 is released from its pushed condition.

Thus, under the condition in which both of the belts 44 and 45 are stopped, the clearance 22 is formed to establish the temporary storing station. In this meanwhile, the intermediate roller 33 acts as a stopper for preventing the piled bank notes A from falling down. Upon the delivery of the bank notes A, therefore, the fourth belt 45 merely warps at its side engaging with the intermediate roller 33.

When the belts 44 and 45 start their rotations, they hold and convey the piled bank notes A to the fourth and fifth belts 46 and 47. The bank notes A delivered from the belts 46 and 47 can be discharged into their tray 37 by the action of the belt 48 while being guided by the change-over guide plate 36. In case, on the contrary, the Operator throws a doubt upon the coincidence between the sum he inserted and the sum indicated by an indicator, he merely operates the change-over guide plate 36 by depressing a button so that the piled bank notes A can be returned from the belts 46 and 47 to the return exit 42 through the belts 39 and 40.

As has been described hereinbefore, according to the present invention, the multiple bank note temporary storing device is constructed as its major components of: the piling station for piling the discontinuously fed multiple bank notes consecutively with a slight shift into a stepwise shape; and the temporary storing station formed in the clearance between the conveyor belts for arranging the piled bank notes while allowing them to fall down into the clearance generally in parallel with the facing sides of the conveyor belts so that the arranged bank notes can be fed as a whole selectively into their tray and the return exit of the bank note totaling machine. As a result, the bank notes fed one by one can be piled once stepwise and then can be arranged without fail. Therefore, the bank note totaling machine equipped with the totaling machine according to the present invention can be reduced in size but can accomplish its arranging and totaling operations in a reduced number of steps orderly and efficiently without any totaling error.

What is claimed is:

1. A multiple bank note temporary storing device for use with a bank note totaling machine, comprising: a piling station for piling a multiplicity of bank notes, which are fed discontinuously one by one, consecutively with a slight shift into a stepwise shape, the piling station including a pair of rotary bails having their centers of rotation fixedly fitted on the both ends of a shaft mounted to said bank note totaling machine, two pairs of scraping rods mounted to the both ends of said rotary bails in an end-to-end facing relationship, a pair of conveyance guide plates fixed to said shaft between said two rotary bails, two pairs of delivery rollers arranged downstream of said conveyance guide plates and shifted from each other, and a holding plate extending at an inclination for preventing the fed bank notes from having their trailing end portions bulged to an excessive extent, and a temporary storing station formed in a clearance between conveyor belts for arranging the piled multiple bank notes while allowing them to fall down into said clearance generally in parallel with the facing sides of said conveyor belts so that the arranged bank notes can be fed as a whole selectively into the bank note tray and the return exit of said bank note totaling machine.

2. A multiple bank note temporary storing device according to claim 1, wherein said piling station further includes a pair of first belts made to run on one pair of said delivery rollers and downstream pulleys driven by a prime mover, and a pair of second belts made to run on the other pair of said delivery rollers and downstream pulleys driven by a prime mover.

3. A multiple bank note temporary storing device according to claim 1, wherein said temporary storing station includes third and fourth belts, an intermediate rollers 33 adapted to be driven by the fourth-named belt, and a guide fork depending from the side of the pulley, on which the first-named belt is made to run, such that a wedge-shaped clearance is formed between the plane leading from the inner wall of said guide fork to the upper outer side of the fourth-named belt and the outer side of the third-named belt.

4. A multiple bank note temporary storing device according to claim 3, wherein said temporary storing station further includes a support plate supported pivotally and having its leading end rotatably supporting one of the pulleys, on which the fourth-named belt is made to run, a link connecting said support plate and a lock solenoid, a torsion spring mounted on the pivot of said support plate for biasing said link and accordingly said support plate in one direction, a lock plate having its portion pivotal, a lock releasing solenoid connected to said lock plate, and an actuating pin mounted to said support plate and sized and positioned to engage with a notch which is formed in said lock plate.

* * * * *